US007084567B2

(12) United States Patent
Chen et al.

(10) Patent No.: US 7,084,567 B2
(45) Date of Patent: Aug. 1, 2006

(54) PLASMA DISPLAY PANEL PERFORMING HIGH LUMINANCE AND LUMINOUS EFFICIENCY

(75) Inventors: Po-Cheng Chen, Yonghe (TW); Jiun-Han Wu, Sanchong (TW); Chen-Kwang Pan, Yilan (TW); Jin-Yuh Lu, Taipei (TW)

(73) Assignee: .AU Optronics Corporation, Hsinchu (TW)

( * ) Notice: Subject to any disclaimer, the term of this patent is extended or adjusted under 35 U.S.C. 154(b) by 218 days.

(21) Appl. No.: 10/687,922

(22) Filed: Oct. 20, 2003

(65) Prior Publication Data

US 2005/0082976 A1 Apr. 21, 2005

(51) Int. Cl.
*H01J 17/49* (2006.01)

(52) U.S. Cl. ..... 313/582; 313/581

(58) Field of Classification Search ..... 313/581–587
See application file for complete search history.

(56) References Cited

U.S. PATENT DOCUMENTS

| | | | | |
|---|---|---|---|---|
| 5,107,182 | A * | 4/1992 | Sano et al. | 313/586 |
| 5,770,921 | A * | 6/1998 | Aoki et al. | 313/581 |
| 6,373,195 | B1 * | 4/2002 | Whang et al. | 315/169.3 |
| 6,388,644 | B1 * | 5/2002 | De Zwart et al. | 313/582 |
| 2002/0130619 | A1 * | 9/2002 | Mori et al. | 313/585 |
| 2002/0175623 | A1 * | 11/2002 | Kim et al. | 313/585 |
| 2005/0067960 | A1 * | 3/2005 | Min | 313/582 |

FOREIGN PATENT DOCUMENTS

| | | | |
|---|---|---|---|
| EP | 779643 | A2 * | 6/1997 |
| JP | 06342631 | A * | 12/1994 |

* cited by examiner

*Primary Examiner*—Mariceli Santiago
(74) *Attorney, Agent, or Firm*—Arent Fox PLLC

(57) ABSTRACT

The present invention relates to a plasma display panel with improved Luminance and luminous efficiency. The panel includes barrier ribs configured to form a plurality of closed cells, with each closed cell having a discharge region filled with a xenon gas of at least 15% by volume, and another gas of 85% or less by volume.

16 Claims, 5 Drawing Sheets

PLASMA DISPLAY PANEL PERFORMING HIGH LUMINANCE AND LUMINOUS EFFICIENCY

BACKGROUND OF THE INVENTION

1. Field of the Invention

The present invention generally relates to improvements in the luminance efficiency of a plasma display panel, and more particularly to a plasma display panel with an improved gas mixture in a closed sub-pixel structure to perform high luminance with improved luminance efficiency, low power consumption, and low heat dissipation.

2. Related Art

A conventional plasma display panels (PDPs) with a stripe structure is shown in FIG. 1. Such open structure type of PDPs typically includes a glass substrate 10 with a plurality of barrier rib 12 formed thereon in parallel. Typically, a neon or xenon gas, or a mixture thereof, is filled in a discharge space. The gas breaks down when a voltage with an appropriate polarity is applied, and is then ionized to produce plasma. By exciting a fluorescent layer using ultraviolet light generated by the plasma, visible light is produced and emitted. The combination of neon and xenon gases typically involves few percentage of xenon gas in the discharge space mixed with a neon-based gas mixture, such as neon-argon or neon-krypton. However, a helium-based gas, such as helium-argon and helium-krypton, can also be used in addition to, or in place of, the neon-based gas.

More specifically, a small percent of xenon gas (i.e., 5% or less) in combination with other gases, such as neon, helium or a combination thereof, constitute the gas mixture. The mixture ratio for the xenon gas is generally set to be less than 5% by volume since exceeding such setting would increase the driving voltage, decrease the operational margin, and negatively impact the luminous efficiency due to plasma saturation, the characteristic of which is proportional to the amount of xenon gas in the gas mixture.

Thus, to avoid the drive voltage from becoming too high or the operational margin from becoming too narrow, conventional PDPs set the gas mixture for the xenon gas at around 1 to 5% by volume. However, such PDPs suffer from low luminous efficiency and low luminance. Additionally, the conventional PDPs require relatively high power consumption, which leads to high heat dissipation.

SUMMARY OF THE INVENTION

Accordingly, the present invention has been made in consideration of the above disadvantages in the conventional PDPs. One feature of the present invention provides a plasma display panel with a closed delta cell structure to reduce or eliminate misfiring or cross-talk between cells.

In another feature, the composition of gas mixture in the plasma display panel includes xenon gas at around 15 to 50% by volume, which increases luminance and luminous efficiency, and reduces power consumption and heat dissipation.

The above features can be achieved by a plasma display panel comprising barrier ribs configured to form a plurality of closed cells, display electrodes formed on a front substrate, and an address electrode formed on a rear substrate. The barrier ribs are disposed between the front and rear substrates to define a delta color pixel structure having a plurality of sub-pixels, wherein each of the sub-pixels has a discharge region which is filled with a first discharge gas of at least 15% by volume, and a second discharge gas of 85% or less by volume.

Additionally, the plasma display panel for above examples can be constructed by a method that comprises configuring barrier ribs to form a closed shape, forming display electrodes on a front substrate, and forming an address electrode on a rear substrate. Particularly, the barrier ribs are disposed between the front and rear substrates to define a delta color pixel structure having a plurality of sub-pixels, and each of the sub-pixels has a discharge region which is filled with a first discharge gas of 50% or less by volume, and a second discharge gas of 50% or more by volume.

DESCRIPTION OF THE DRAWINGS

The accompanying drawings, which are included to provide a further understanding of the present invention and are incorporated in and constitute a part of this specification, illustrate examples of the present invention and together with the description serve to explain the principles of the present invention. In the drawings.

DETAILED DESCRIPTION OF EXEMPLARY EMBODIMENTS

Reference will now be made in detail to the exemplary embodiment of the present invention, examples of which are illustrated in the accompanying drawings.

Figure 1:
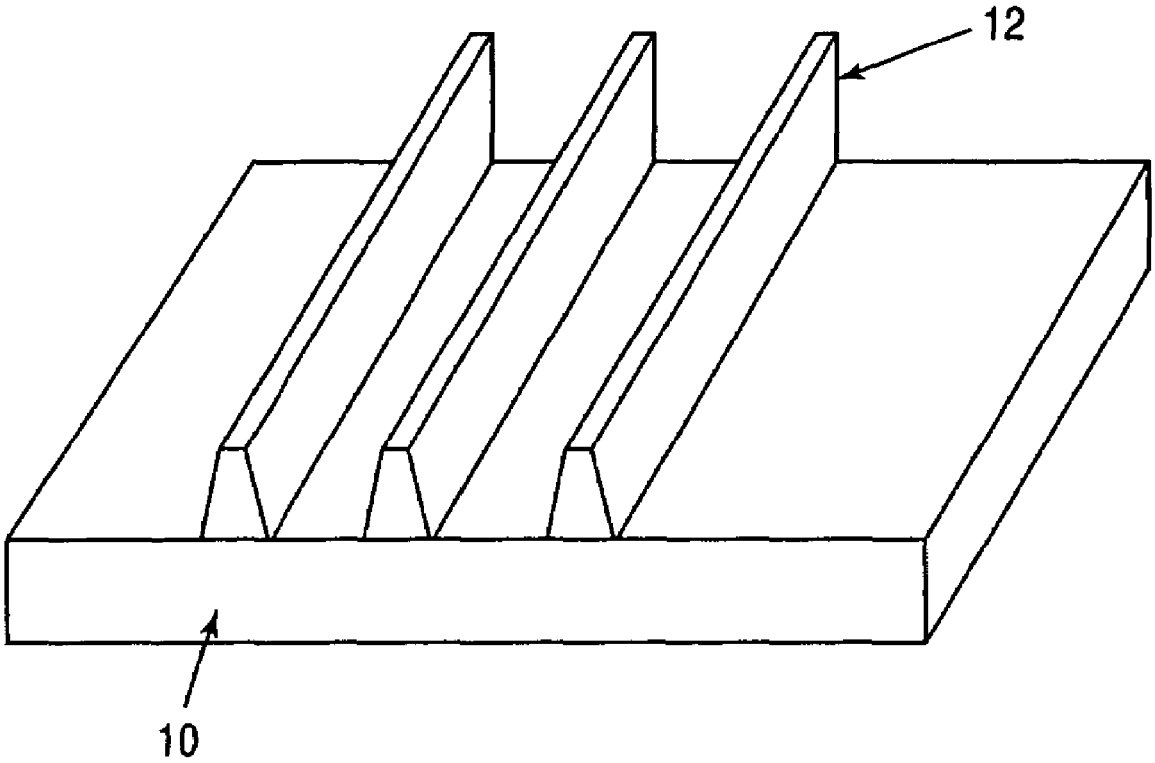
FIG. 1 Prior Art
FIG. 1 illustrates a strip type of barrier ribs in a conventional plasma display panel.
Figure 2:
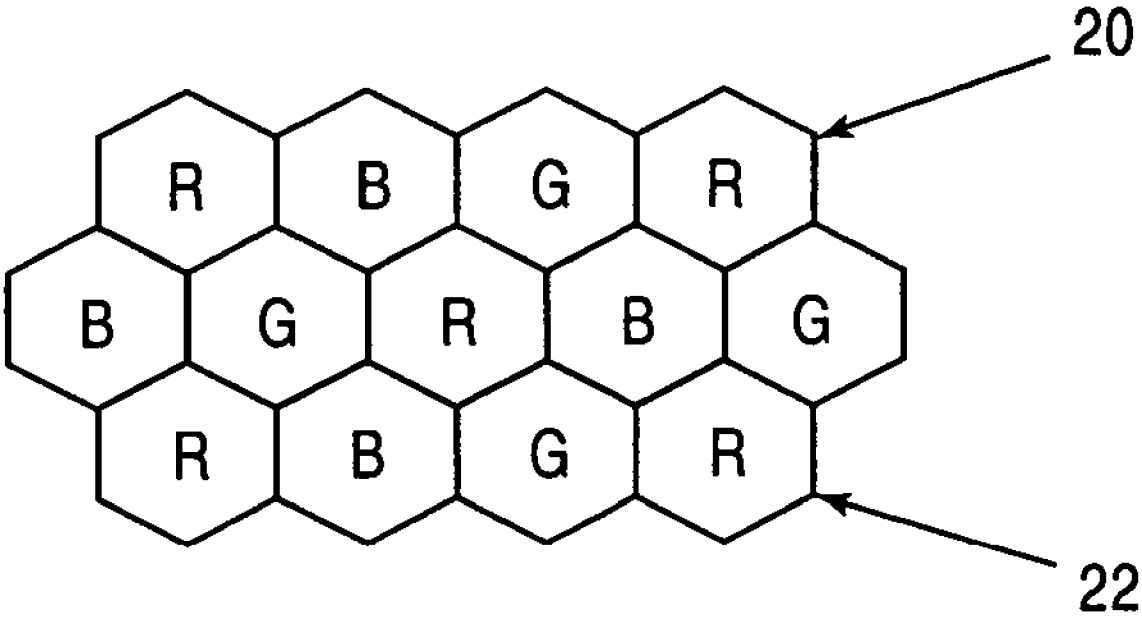
FIG. 2 illustrates a closed type of barrier ribs in polygonal shape in accordance with an exemplary embodiment of the present invention.

The present invention is directed to a plasma display panel which is constructed using a closed barrier rib structure 20 and a triangular sub-pixel arrangement. As shown in FIG. 2, the barrier ribs define plurality of closed discharge cells 22, with each discharge cell corresponding to a blue, red or green sub-pixel. A color pixel is comprised of a blue, red and green sub-pixel in a delta formation.

Figure 3:
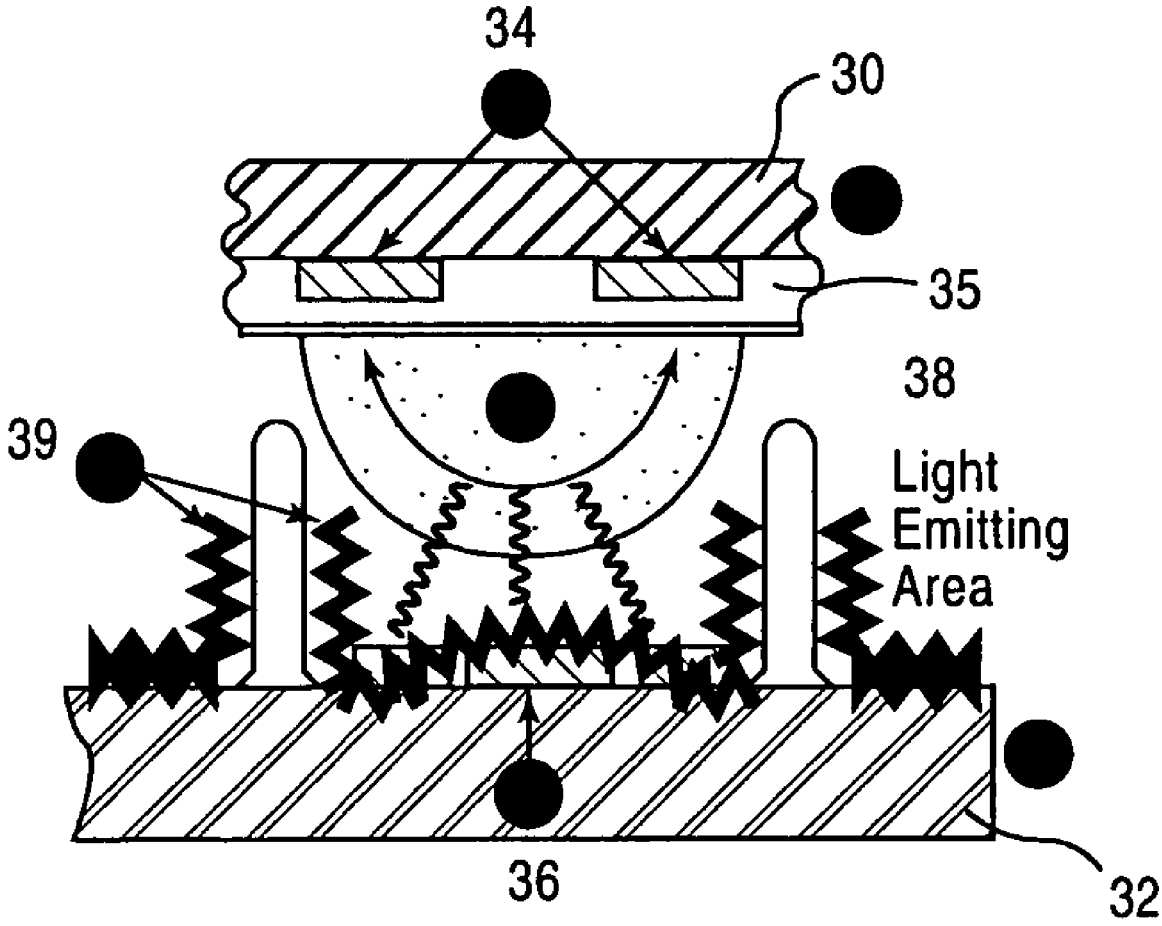
FIG. 3 illustrates a plasma display panel in accordance with the exemplary embodiment of the present invention.

The plasma display panel as shown in FIG. 3 is consisted of a pair of parallel substrates including a front substrate 30 and a rear substrate 32. A pair of bus or display electrodes 34 parallel to each other are formed on the front substrate 30 and extending along a first direction. Further, a protective dielectric layer 35 is formed to the cover the front substrate 30 and the pair of bus electrodes 34. On the rear substrate 32, an address electrodes 36 is formed thereon and extending along a second direction that is orthogonal to the first direction. A plurality of barrier ribs 38 parallel to the plurality of address electrodes 34 are then formed on the rear substrate 32. Finally, a fluorescent layer 39 is formed between the plurality of barrier ribs for luminescence when a phosphor layer 39 is radiated by ultraviolet light generated from the gas or gas mixture in a discharge space.

More specifically, each discharge cell is enclosed by the front and rear substrates which are separated by barrier ribs 38. A front substrate section includes the bus/display electrodes 34 formed onto the front substrate 30 and covered by the protective dielectric layer 35. On the other hand, a rear substrate section consists of the rear glass substrate 32 with the address electrode 36 formed thereon. Barrier ribs 38 constitute partition walls between the front and rear substrates. The phosphor layer 39 of a red, green, or blue fluorescence is injected to cover the surfaces of the partition walls and the rear substrate section. The resulting plasma display panel is formed by bonding the front and rear substrate sections with a sealant.

Figure 4:
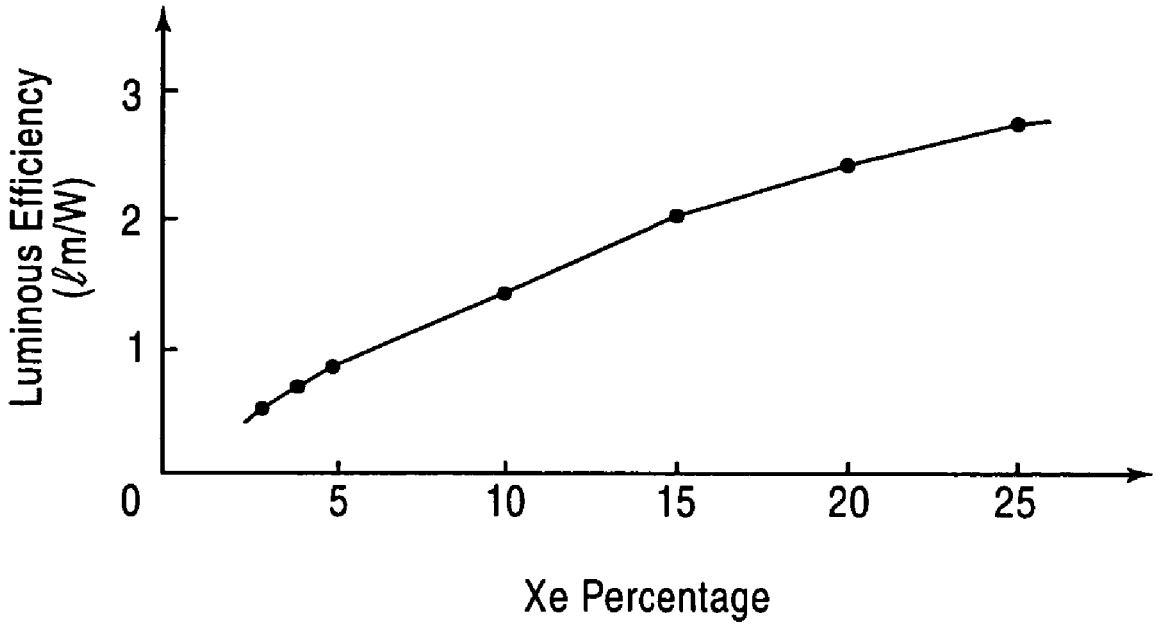
FIG. 4 is a graph showing the relationship between the luminance efficiency and the xenon gas percentage.
Figure 5:
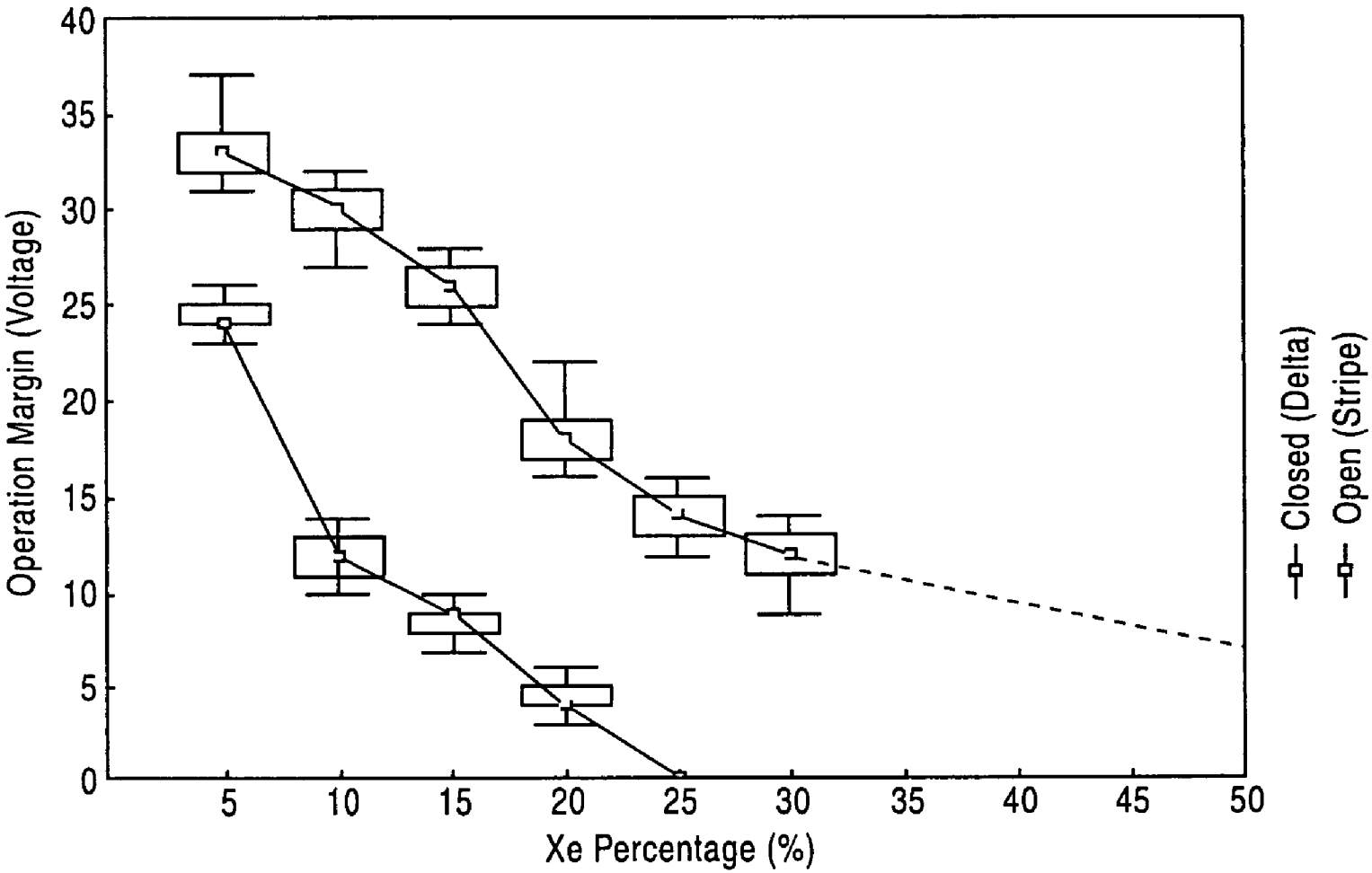
FIG. 5 is a graph showing the relationship between the operation margin and the xenon percentage.

FIG. 4 illustrates the relationship between the luminance efficiency and the xenon gas percentage. Particularly, as the percentage of xenon gas increases in the neon or helium-based gas mixture, the luminous efficiency also increases (Im/W). However, as shown in FIG. 5, which is a graph indicating the relationship between the operation margin and the xenon percentage, increasing the percentage of xenon gas in the neon or helium-based gas mixture will also reduce the operational margin in the conventional plasma display panel of strip barrier ribs type. Such reduction is highly undesirable since it leads to low luminous efficiency and high heat dissipation. However, by setting the gas mixture for the xenon gas at around 15 to 50% by volume, the plasma display panel of the present invention, which is of a closed (delta) type of barrier ribs, successfully improves the luminous characteristics while retaining acceptable operational margins to provide steady voltage as shown in FIG. 5. The closed (delta) type of barrier ribs also minimize any misfiring or cross-talk between the discharge cells or sub-pixels.

It is also evident from the graph result as shown in FIG. 5 that the operation margin for the plasma display panel is not less than 10 voltages when the discharge region, which is coated with a phosphor layer, is filled with the xenon gas of 30% by volume. By contrast, the conventional plasma display panel of open stripe barrier ribs would have a zero operational margin when the xenon gas percentage reaches 25% or more.

Two illustrative equations for the composition of the gas mixture are shown below:

$$15\%\ \text{Xenon}+85\%\ (\text{Gas}_1+\text{Gas}_2+\text{Gas}_{n1})$$

$$50\%\ \text{Xenon}+50\%\ (\text{Gas}_1+\text{Gas}_2+\text{Gas}_{n2})$$

We claim:

1. A plasma display panel comprising:

barrier ribs configured to form a plurality of closed cells;

display electrodes formed on a front substrate; and an address electrode formed on a rear substrate, with said barrier ribs disposed between said front and rear substrates to define a delta color pixel structure having a plurality of sub-pixels, wherein each of the sub-pixels has a discharge region which is filled with a first discharge gas of at least 15% by volume, and a second discharge gas of 85% or less by volume, and wherein said first gas is a xenon gas.

2. The plasma display panel of claim 1, wherein said second gas is a neon-based or helium-based gas mixture.

3. The plasma display panel of claim 2, wherein said neon-based gas mixture is neon-argon or neon-krypton.

4. The plasma display panel of claim 3, wherein said helium-based gas mixture is helium-argon and helium-krypton.

5. The plasma display panel of claim 2, wherein an operation margin for the plasma display panel is not less than 10 voltages when said discharge region is filled with the xenon gas of 30% by volume.

6. The plasma display panel of claim 1, wherein said discharge region is coated with a phosphor layer.

7. A plasma display panel comprising:

barrier ribs configured to form a closed shape;

display electrodes formed on a front substrate; and an address electrode formed on a rear substrate, with said barrier ribs disposed between said front and rear substrates to define a delta color pixel structure having a plurality of sub-pixels, wherein each of the sub-pixels has a discharge region which is filled with a first discharge gas of 50% or less by volume, and a second discharge gas of 50% or more by volume, and wherein said first gas is a xenon gas, and wherein an operation margin for the plasma display panel is not less than 10 voltages when said discharge region is filled with the xenon gas of 30% by volume.

8. The plasma display panel of claim 7, wherein said second gas is a neon-based or helium-based gas mixture.

9. The plasma display panel of claim 7, wherein said neon-based gas mixture is neon-argon, and neon-krypton.

10. The plasma display panel of claim 7, wherein said helium-based gas mixture is helium-argon and helium-krypton.

11. The plasma display panel of claim 7, wherein said discharge region is coated with a phosphor layer.

12. A method of constructing a plasma display panel comprising:

configuring barrier ribs to form a closed shape;

forming display electrodes on a front substrate; and forming an address electrode on a rear substrate, with said barrier ribs disposed between said front and rear substrates to define a delta color pixel structure having a plurality of sub-pixels, wherein each of the sub-pixels has a discharge region which is filled with a first discharge gas of 50% or less by volume, and a second discharge gas of 50% or more by volume, and wherein said first gas is a xenon gas, and wherein an operation margin for the plasma display panel is not less than 10 voltages when said discharge region is filled with the xenon gas of 30% by volume.

13. The method of claim 12, wherein said second gas is a neon-based or helium-based gas mixture.

14. The method of claim 12, wherein said neon-based gas mixture is neon-argon and neon-krypton.

15. The method of claim 12, wherein said helium-based gas mixture is helium-argon and helium-krypton.

16. The method of claim 12, wherein said discharge region is coated with a phosphor layer.

* * * * *